US006427398B1

(12) United States Patent
Levine et al.

(10) Patent No.: US 6,427,398 B1
(45) Date of Patent: Aug. 6, 2002

(54) METHOD OF MAKING WINDOW FRAME COMPONENTS HAVING VARIOUS END USING APPLICATIONS

(75) Inventors: David S. Levine, Bethesda, MD (US); Jerome Carl Habeck, Holt; Dennis C. Westphal, Parma, both of MI (US); Stanley Gursky, Yardley, PA (US); Timothy J. Steller, Brooklyn, MI (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 09/564,435

(22) Filed: May 4, 2000

(51) Int. Cl.[7] ..... E06B 3/96

(52) U.S. Cl. ..... 52/204.56; 52/100; 52/745.15

(58) Field of Search ..... 52/98, 100, 745.15, 52/745.19, 204.56, 204.55, 211, 213, 217

(56) References Cited

U.S. PATENT DOCUMENTS

| | | | | | |
|---|---|---|---|---|---|
| 3,344,575 | A | | 10/1967 | Grossman | 52/656.5 |
| 3,855,746 | A | | 12/1974 | Leggiere | 52/213 |
| 3,984,954 | A | | 10/1976 | Takeda | 52/213 X |
| 3,984,955 | A | | 10/1976 | Yamamoto et al. | 52/213 X |
| 4,110,942 | A | * | 9/1978 | Slocomb, Jr. | 52/100 |
| 4,231,207 | A | | 11/1980 | Kern et al. | 52/730.3 |
| 4,411,111 | A | | 10/1983 | Hosooka | 52/204.55 |
| 4,870,791 | A | | 10/1989 | Nelson | 52/213 X |
| 5,157,881 | A | * | 10/1992 | Tashman et al. | 52/98 |
| 5,392,574 | A | | 2/1995 | Sayers | 52/217 |
| 5,557,894 | A | | 9/1996 | Card | 52/104.55 X |
| 5,608,637 | A | * | 3/1997 | Wang et al. | 364/468.03 |
| 5,660,010 | A | | 8/1997 | Sayers | 52/217 |
| 6,006,478 | A | | 12/1999 | Hubner et al. | 52/656.5 X |
| 6,044,611 | A | | 4/2000 | Brunett | 52/208 X |
| 6,055,782 | A | | 5/2000 | Morton et al. | 52/204.1 |
| 6,119,324 | A | * | 9/2000 | Suess | 29/417 |
| 6,182,405 | B1 | | 2/2001 | Lindahl | 52/208 X |
| 6,237,208 | B1 | * | 5/2001 | Meeth | 29/403.1 |
| 6,243,999 | B1 | | 6/2001 | Silverman | 52/213 X |

FOREIGN PATENT DOCUMENTS

| | | | |
|---|---|---|---|
| DE | 2416390 | 11/1974 | 52/211 |
| GB | 2221713 | 2/1990 | 52/213 |
| GB | 2254096 | 9/1992 | 52/213 |

OTHER PUBLICATIONS

Noranda Building Products Pamphlet, "Series 1000 and Series 2000 Thermalized Aluminum Windows" (1985).

Norandex, "A Full Line of Energy Efficient Aluminum and Vinyl Windows and Patio Doors", Sep. 1988, pp. 1–31 (1998).

* cited by examiner

*Primary Examiner*—Beth A. Stephan
*Assistant Examiner*—Naoko Slack
(74) *Attorney, Agent, or Firm*—Duane Morris LLP

(57) ABSTRACT

A method is described of making a plurality of window frame members having different end use applications on a single production line. The method comprises the step of extruding from a single die plate a master window frame member having at least two flange portion extending therefrom. The method also comprises the step of cutting at least one flange portion at a predetermined location to create a functional frame member having a specific end use application.

20 Claims, 16 Drawing Sheets

METHOD OF MAKING WINDOW FRAME COMPONENTS HAVING VARIOUS END USING APPLICATIONS

CROSS-REFERENCE TO RELATED APPLICATIONS

This application is related to application Ser. No. 09/564,434 of David S. Levine, Jerome C. Habeck, Dennis C. Westphal and Stanley Gursky, entitled "Window frame member with channel formed within the member for accepting siding or sheathing," filed in the Patent and Trademark Office on the same day this application is being filed.

FIELD OF THE INVENTION

The present invention relates to window frame construction, and more specifically to a method of manufacturing window frame members having various end use applications.

BACKGROUND OF THE INVENTION

Many window frames and frame members are prefabricated. These window frames and frame members are often constructed from vinyl, aluminum, or composite materials. The window frames are typically installed during new construction of a building, such as a house, or during replacement of existing windows.

During new construction, a window frame is normally installed within a rough opening formed within and defined by the frame of a building structure. Typically, a window frame used in new construction applications includes a nailing flange extending radially from the window frame and around the rough opening. During installation, nails, staples or other fastening means are used to secure the nailing flange, and thus the window frame, to the plywood sheathing of the building.

Replacement window frames are often installed over an existing window frame of a building, either during renovation of the structure or during replacement of the structure's windows. The existing window is first removed, and the remaining window frame is prepared for installation of the replacement window frame. The existing frame is usually constructed from wood or from a metal, such as aluminum. Alternatively, the existing window and its frame may be removed, thereby leaving a rough opening in the building structure. This rough opening is then prepared to accept the replacement window frame.

Preparation of the existing frame or rough opening includes several steps, such as removing chips and rough edges in existing wooden window frames, fastening wood blocks into the sash track of an existing metal frame sill component to help support the weight of the new window, or cleaning and checking a rough frame opening for squareness. The replacement window frame is often secured by driving screws through pre-drilled holes in the interior of the replacement window frame and into the existing frame or rough opening.

A replacement window frame may include a flange, often called a flush fin, that extends radially from the window frame and around the exterior of the window frame opening after installation. The flush fin conceals any gaps created during preparation of the existing window frame or any damaged areas surrounding the window frame or rough opening. Flush fin window designs are often used when replacing window frames in buildings having stucco exteriors. The nuances of new construction and replacement window installation are generally known to window frame installers in the industry and may be found in installation instruction workbooks and manuals published by window frame manufacturers.

The design of a window frame member, such as a picture window frame member, double-hung window frame member or awning window frame member, to name a few, varies according to the particular end use application, i.e., the type of installation for which the frame member, and consequently the assembled frame, will be used. For example, a window frame member may have a nailing flange if it is to be used in a new construction application. This same jamb may also have a flange or flanges used to create a conventional J-channel for accepting or covering siding or sheathing that is attached to a building structure. The window frame member may also have no flanges or a flush fin flange, for example, if it is intended for use in a replacement window frame. Different designs for the same window frame member, therefore, are used for different applications.

Prefabricated window frame members are often formed from a material such as vinyl or polyvinyl chloride (PVC) using extrusion processes. Molten metal or plastic is forced, drawn or extruded through a die for shaping into window frame members. The die is usually made from a material such as brass. In order to manufacture the different designs of a window frame member for use in the aforementioned different applications, each design is created using a different die in the extrusion process. Alternatively, a single die having additional die plates is used to create the different designs. After extrusion, the extruded window frame member continues to a cooling tank section where it is reshaped and cooled in order to harden the member. The member may then be cut into usable or transportable lengths of window frame member. The details of extrusion, reshaping and cooling are know in the art and are disclosed, for example, in *Engineered Materials Handbook, Volume* 2, *Engineering Plastics,* Robert L. Miller, "Thermoplastic Extrusion," pp. 378–88.

The aforementioned manufacturing technique, however, has several disadvantages. First, dies are very expensive, often costing several hundred thousand dollars. Therefore, the use of multiple dies or additional die plates greatly compounds manufacturing costs. Also, the use of multiple dies requires either longer production lines or multiple production lines, resulting in increased operating costs as well as increased space consumption.

As mentioned, window frame members are sometimes manufactured with J-channels formed integrally therewith or as attachable accessories. These J-channels are constructed to accept siding or sheathing attached to the building structure and to partially cover the siding or sheathing. The sheathing or siding is generally constructed from aluminum or vinyl. The J-channel of a jamb member is constructed to cover the ends of the siding or sheathing. The J-channel is usually constructed with sufficient depth to adequately cover the ends of the siding or sheathing during expansion and contraction resulting from temperature changes. The J-channels also help to exclude water from the siding or sheathing and to cover misalignments of the ends of the sheathing or siding. It has been found that a channel of approximately 0.750 inch is normally sufficient to cover the ends as the sheathing or siding expands or contracts. It should be apparent that the J-channel of a header or a sill member covers the bottom or top, respectively, of siding or sheathing that is attached to a building structure.

Conventional J-channels are usually formed such that they extend from the wall-facing side of a frame or frame member, that side of the window frame facing the opening in a building that accepts the window frame and opposite the window supported by the frame. The J-channel generally has a return flange extending from the wall facing-side, typically 0.750 inch in length, that covers the ends of the siding or sheathing attached to the structure. The J-channel is formed from a nailing flange extending from the wall-facing side, a projection portion extending away from the nailing flange portion in a direction usually normal to the nailing flange portion, and the return portion connected to the projection portion and disposed opposite and parallel to the nailing flange portion. This configuration creates a substantially rectangular channel that has a longitudinal opening for receiving the free end of a siding or sheathing panel. The nailing flange typically extends one inch past the return flange (i.e., the nailing flange extends 1.750 inches from the wall facing side) in order to allow sufficient room to attach the flange, usually by a series of nails, to the structure. Window frame members with J-channels such as that described above are disclosed in U.S. Pat. No. 5,392,574 to Sayers and U.S. Pat. No. 5,660,010 to Sayers.

The aforementioned J-channel design, however, creates several problems. First, the J-channel design increases the "sight-line" of the frame member by about 0.750 inch, and thereby decreases the attractiveness of the window frame. The frame member "sight-line" for purposes of this application is defined as the visible width of the frame member as viewed from the exterior of the building structure. It has been recognized that a more attractive frame member has a reduced "sight-line" because the ratio of visible window to visible frame increases as the sight-line decreases. Also, significant expenses are incurred during manufacturing a window frame member having a conventional J-channel because additional materials are required to form the J-channel's return flange, nailing flange, and projection portion. This is particularly true if a plastic extrusion process is utilized to manufacture the window frame member because approximately one half of the costs of producing plastic extrusions can be attributed to the raw materials, such as polyvinyl chloride resin.

Therefore, there is presently a need for a new method of creating frame members that have varied end use applications from a single die plate. Further, there is presently a need for an aesthetically pleasing and cost effective window frame member that can effectively conceal portions of a siding or sheathing product attached to a building.

SUMMARY OF THE INVENTION

As herein described, the present invention is a method of making a plurality of window frame members having different end use applications on a production line. The method comprises the step of extruding from a single die plate a master window frame member having at least two flange portions extending therefrom. The method also comprises the step of cutting at least one flange portion at a predetermined location to create a frame member having a specific end use application.

As herein described, the present invention is also a master window frame member extruded from a single die plate. The master window frame member comprises at least two flange portions extending therefrom, such that cutting at least one flange portion at a predetermined location on the master window frame member produces a window frame member having a specific end use application.

This method of making a plurality of window frame members on a single production line provides several benefits over prior production methods. First, the method requires only a single die to form a master window frame member that may be used to create a plurality of functional window frame members. The method, therefore, affords significant savings in capital expenditure. Also, the method permits a plurality of window frame members having different end use applications to be manufactured on the same production line. This benefit facilitates significant production line savings in both operating area and operating costs.

The above and other advantages and features of the present invention will be better understood from the following detailed description of the preferred embodiments of the invention which is provided in connection with the accompanying drawings.

DETAILED DESCRIPTION OF THE PREFERRED EMBODIMENTS

The preferred embodiment of the invention is described hereafter using a picture window frame and frame members.

The use of a picture window frame and frame members, however, is for illustrative purposes only. It should be apparent that the description of the invention and the concepts contained in this disclosure apply equally to non-picture windows and frames, such as double-hung, single-hung, glider, casement, round, rectangular and awning windows, to name a few.

Figure 1:
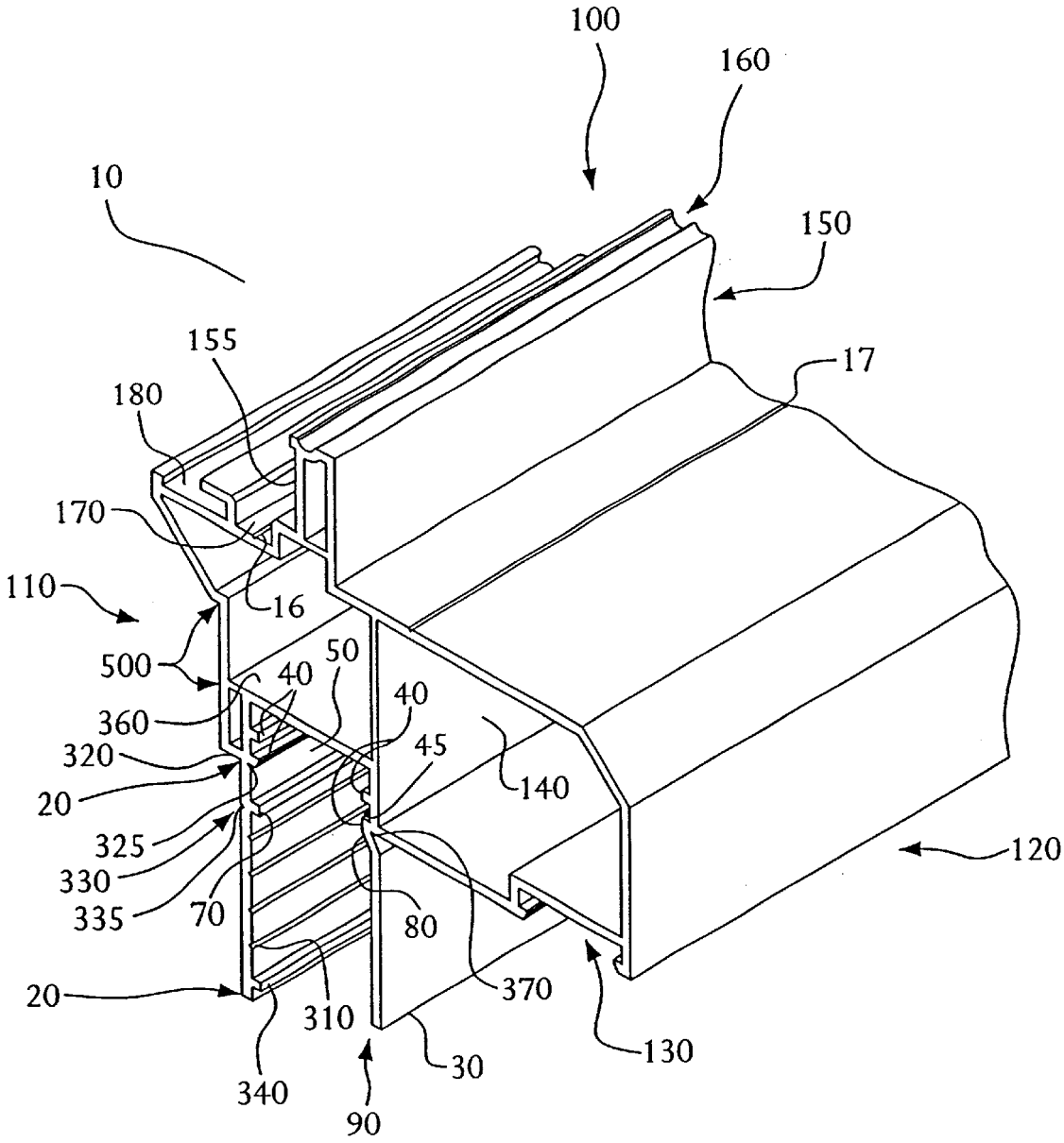
FIG. 1 is a perspective view, shown in partial, of an exemplary embodiment of a master window frame member.
Figure 10:
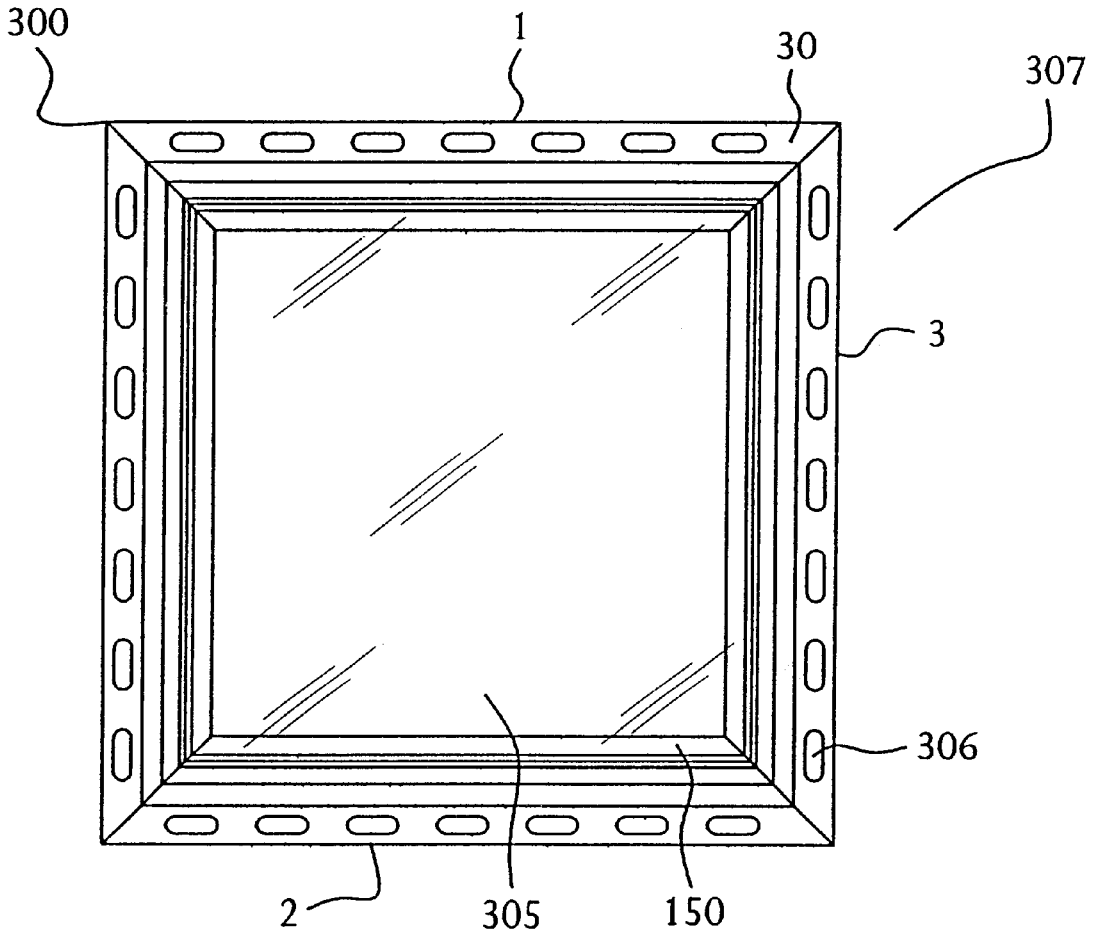
FIG. 10 is a front elevational view of the exterior surface of an exemplary embodiment of a window frame assembly including window frame members as shown in FIG. 4.

FIG. 1 shows a partial perspective view of a master window frame member 10 that may be used to create window frame members for inclusion in a window frame, such as the window frame 300 shown in FIG. 10. FIG. 10 shows a front elevational view of the exterior surface of an exemplary embodiment of a window frame assembly 307. The window frame members that may be created from the master window frame member 10 may be included in a window frame 300 that receives and supports a picture window 305. Picture windows are non-moving windows and thus do not require frame devices such as balances. Also, picture windows do not include sashes, rather the window is typically secured directly to the frame by an adhesive. Further, each window frame member of a picture window generally has a uniform design, such that separate designs for jambs, headers and sills are not required.

The structure of the master window frame member 10 is described hereafter. Then, a method of making a plurality of window frame members having different end use applications on a single production line is described. Also, various window frame members that may be created from the master window frame member 10 are discussed along with their particular end use applications. Further, a new window frame member that is capable of accepting and partially covering a siding or sheathing product is described.

Figure 2:
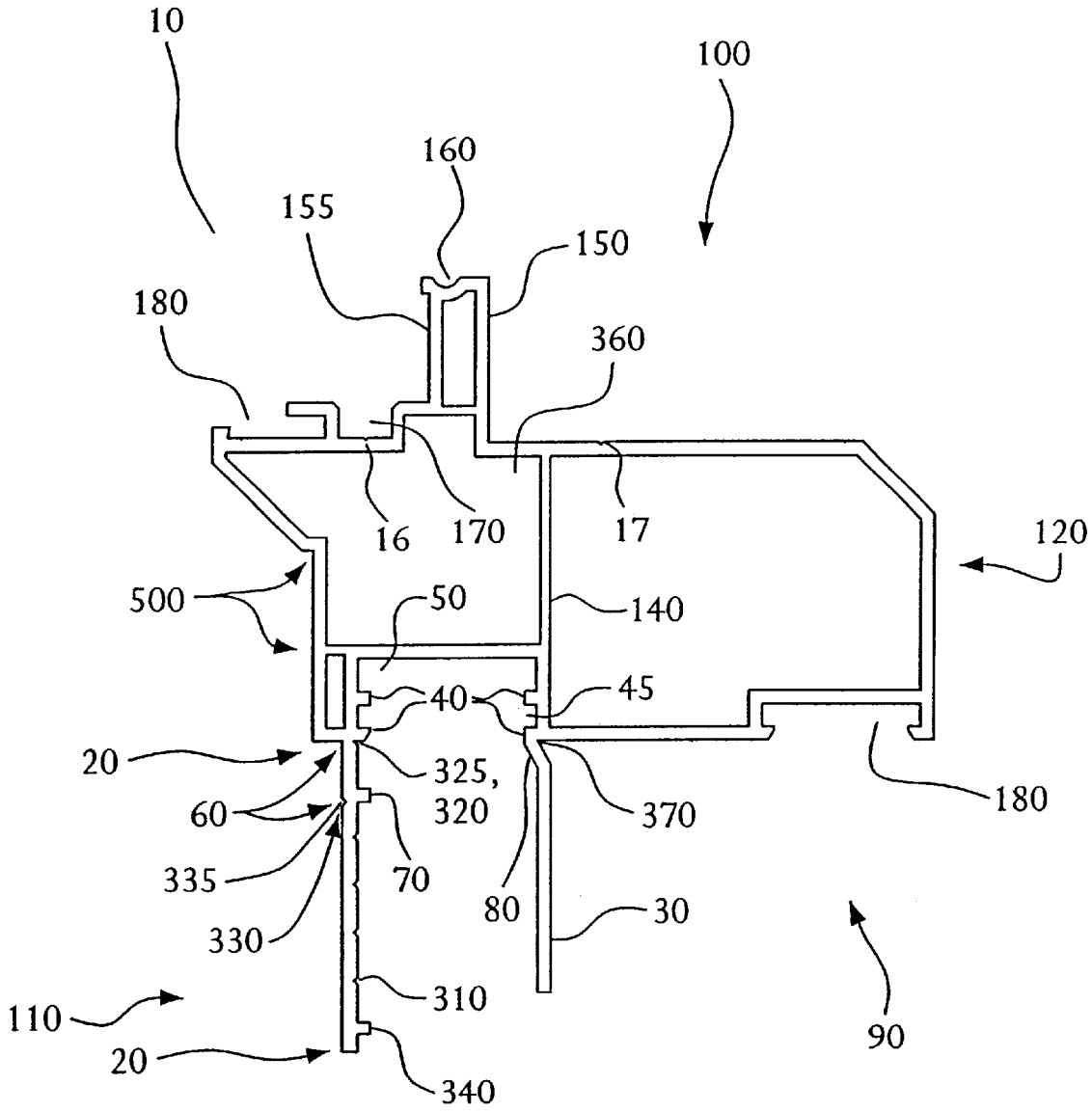
FIG. 2 is a profile view of the master window frame member of FIG. 1.
Figure 3:
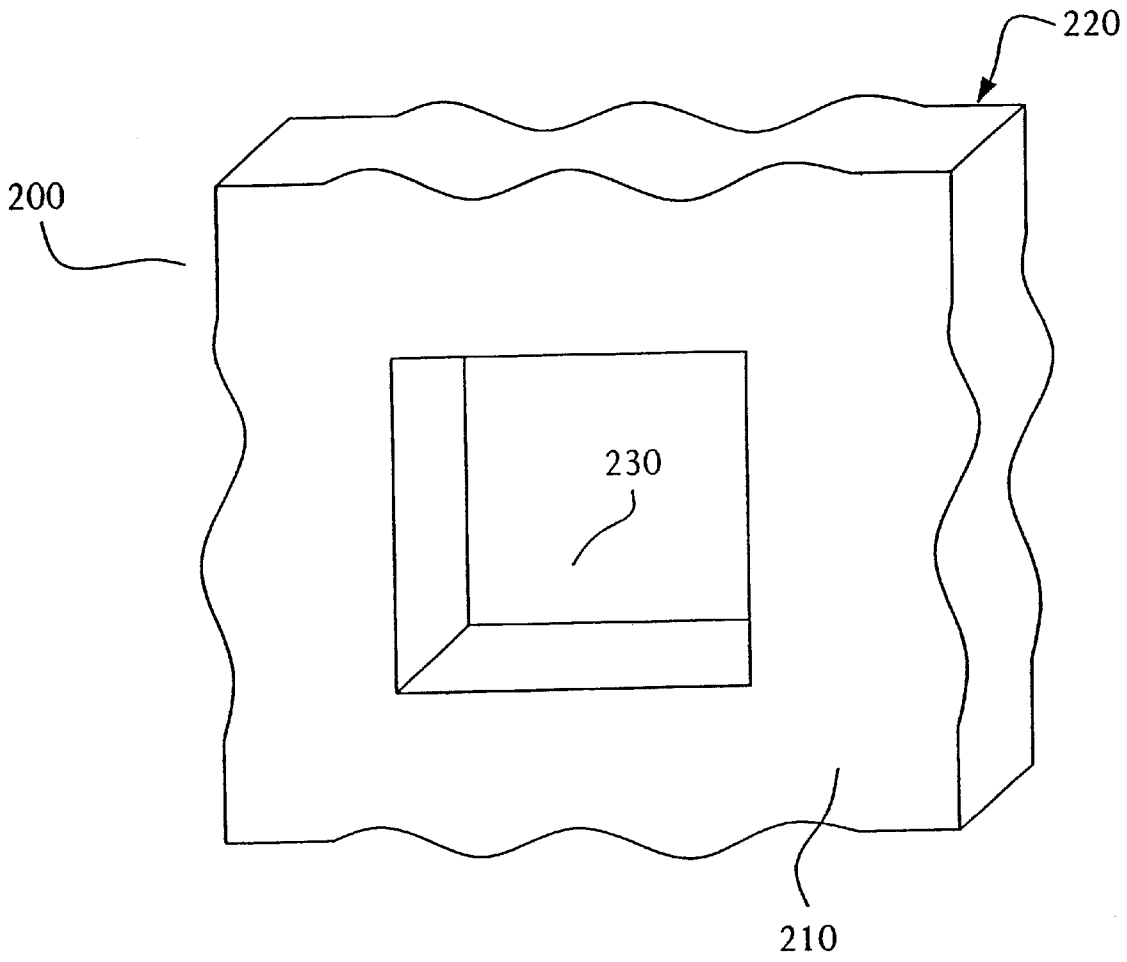
FIG. 3 is a partial perspective view of an opening in a wall of a structure.

Referring to FIGS. 1 and 2, a master window frame member 10 is shown from which window frame members for inclusion in a window frame, such as the window frame 300 of FIG. 10, may be created. The window frame 300 may be mounted in an opening 230 in a wall 200 of a building structure, as shown in FIG. 3. The building structure is not shown, but the structure may be any building such as a house or office building. The structure may be defined by an interior wall 220 and an exterior wall 210.

The master window frame member 10 is defined generally by an interior surface 120 disposed proximate to the interior wall 220 when the window frame assembly 307 is mounted and an exterior surface 110 disposed opposite the interior surface 120 and proximate to the exterior wall 210 when the window frame assembly 307 is mounted. The master window frame member 10 is also defined by a window-facing side 100 disposed to engage the window 305 and a wall-facing side 90 disposed opposite the window-facing side 100.

The master window frame member 10 may comprise a channel 50 formed within the cross-sectional area defined by the interior and exterior surfaces 120,110 and the window-facing and wall-facing sides 100,90. The master window frame member 10 comprises at least two flange portions 20,30 extending from the wall facing side 90. The flange portions 20,30 permit the master window frame member 10 to be modified to create a window frame member having a particular end use application. Flange 30 is commonly called a nailing flange. Flange 20 is commonly called a flush fin. Flange 20 also includes a cover flange portion 60 that is a separate flange portion if a portion of flange 20 is removed. The uses for, and various combinations of, these flanges are discussed in conjunction with the various window frame members that may be created from the master window frame member 10.

As mentioned, master window frame member 10 is a master window frame member for a picture window. In a completed window frame assembly 307 including a header frame member 1, a sill frame member 2 and jamb frame members 3,3, window seat 150 extends radially and continuously from the window-facing side 100 of the window frame members included in window frame member 300 and created from the master window frame member 10. A window 305 is seated against the window seat 150 on its exterior surface 155 and is preferably secured to the seat 150 using a water-tight layer of silicone. Weep channel 170 may be formed on the window-facing side 100 of master window frame member 10. At least one hole (not shown) may be drilled or punched along groove 16 in the weep channel 170 of a sill member 2. Water may then drain into the cavity 360 and away from a seated window 305. Portions of the exterior surface 110 of a sill member 2 may be removed along surface 500, normally toward the ends of the sill frame member 2, so that a weep housing may be attached to the sill frame member 2. This weep housing (not shown) is basically a one way valve that allows water that collects in cavity 360 to drain, or "weep," from the weep cavity 360. Water is thereby deterred from collecting under a seated window 305 and condensation is prevented from forming if window 305 includes insulated glass panels.

The window seat 150 also includes a grid slot 160 that, like the window seat 150, is continuously formed in a completed window frame 300. The grid slot 160 is shaped to permit a decorative grid accessory to be secured over a window 305 that is secured to the window seat 150. The master window frame member 10 may also include a support column 140 formed within the profile of the master window frame member 10. The support column 140 assists the master window frame member 10 maintain its manufactured form and adds stability to the master window frame member 10.

The master window frame member 10 may also include a glazing bead channel 180 formed on the window-facing side 100 of the master window frame member 10. The glazing bead channel 100 is shaped to permit decorative glazing beads (not shown) to be secured to a window frame member created from the master window frame member 10. Similarly, interior accessory channel 130 is formed on the wall-facing side 90 of master window frame member 10. The interior accessory channel 130 is shaped to accept and secure interior window accessories such as trim (not shown) to the master window frame member 10.

The present invention is a method of making a plurality of window frame members having different end use applications on a single production line. The method includes the step of extruding a master window frame member, such as the above-described master window frame member 10, from a single die plate. The master window frame member comprises at least two flange portions extending therefrom, such as flange portion 30 and flange portion 20, which includes flange portion 60. The method also includes the step of cutting at least one flange at a predetermined location to create a functional frame member having a specific end use application. As mentioned, the specific end use applications are described, hereafter, along with the functional window frame members that may be created from master window frame member 10.

There are several possible predetermined locations to cut the master window frame member 10 in order to create a functional window frame member. For instance, the master window frame member may be cut at predetermined location 370, the location where flange 30 meets wall-facing side 90, in order to remove flange 30. The master window frame member 10 may also be cut at predetermined location 320 where flange 60 meets the wall-facing side 90, thereby severing flange 60 and flange 20 from the master window frame member 10. Likewise, the master window frame member 10 may also be cut at predetermined cutting location 330 to remove the portion of flange 20 extending from flange 60.

Cutting grooves, such as cutting groove 325 and cutting groove 335, may also be formed at the predetermined locations 320, 330 to facilitate precision cutting. These cutting grooves 325, 335 may be formed on the master window frame member 10 during the extrusion process. The cutting grooves 325, 335 may be used to help guide an online trimming knife to partially cut through a flange in order to facilitate the separation of the flange from the master window frame member further down a production line.

Multiple cuts may be used to create various flange combinations. For example, cuts may be made at predetermined location 370 and at predetermined location 320 to remove both flanges 20,30. Also, cuts may be made at predetermined location 370 and at predetermined location 330 to leave only flange 60. Therefore, a plurality of flange combinations may be created by cutting at a predetermined location or by cutting at a plurality of predetermined locations.

Figure 12:
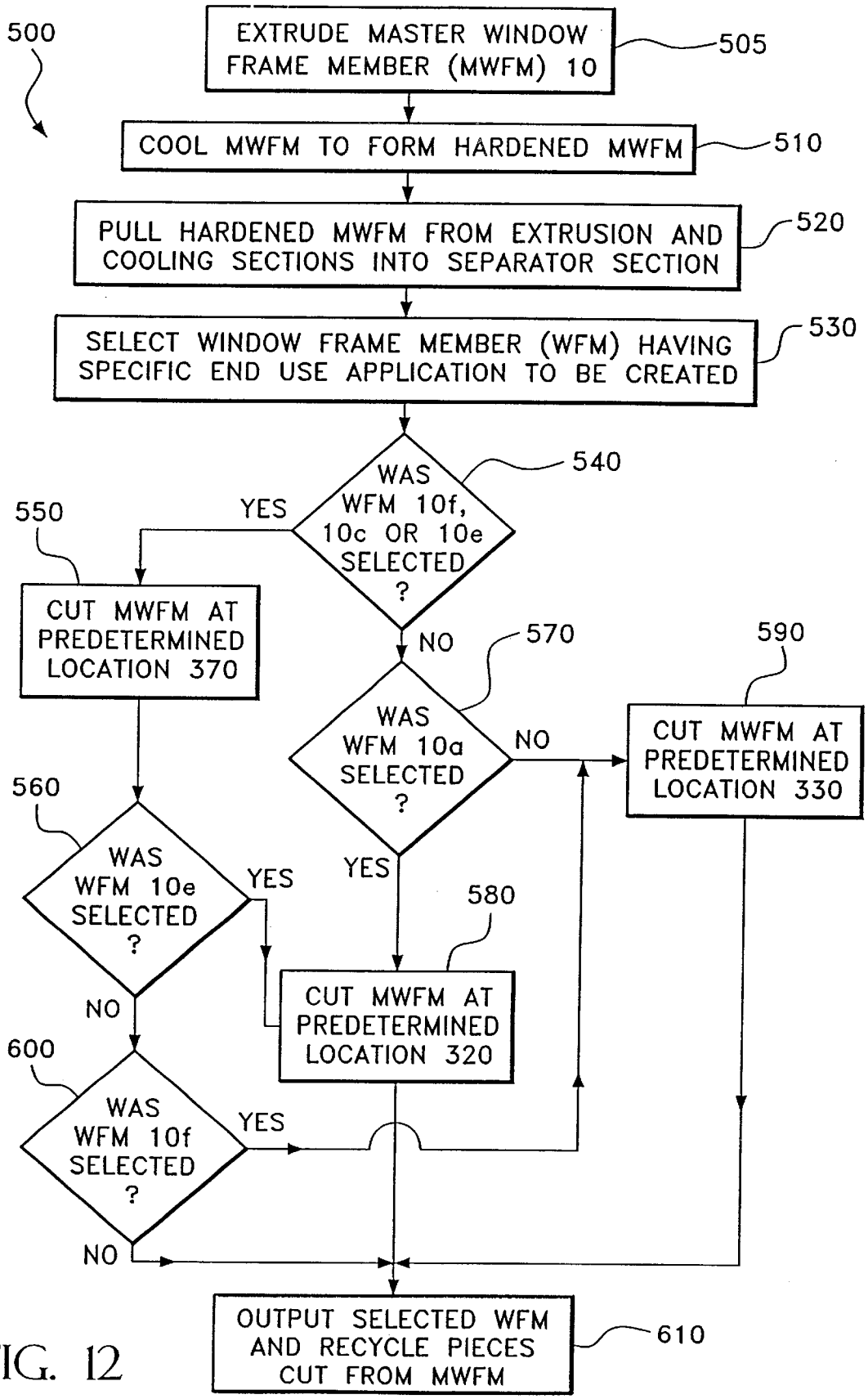
FIG. 12 is a block diagram of an exemplary method of creating a plurality of window frame members having specific end use applications from a master window frame member.
Figure 13:
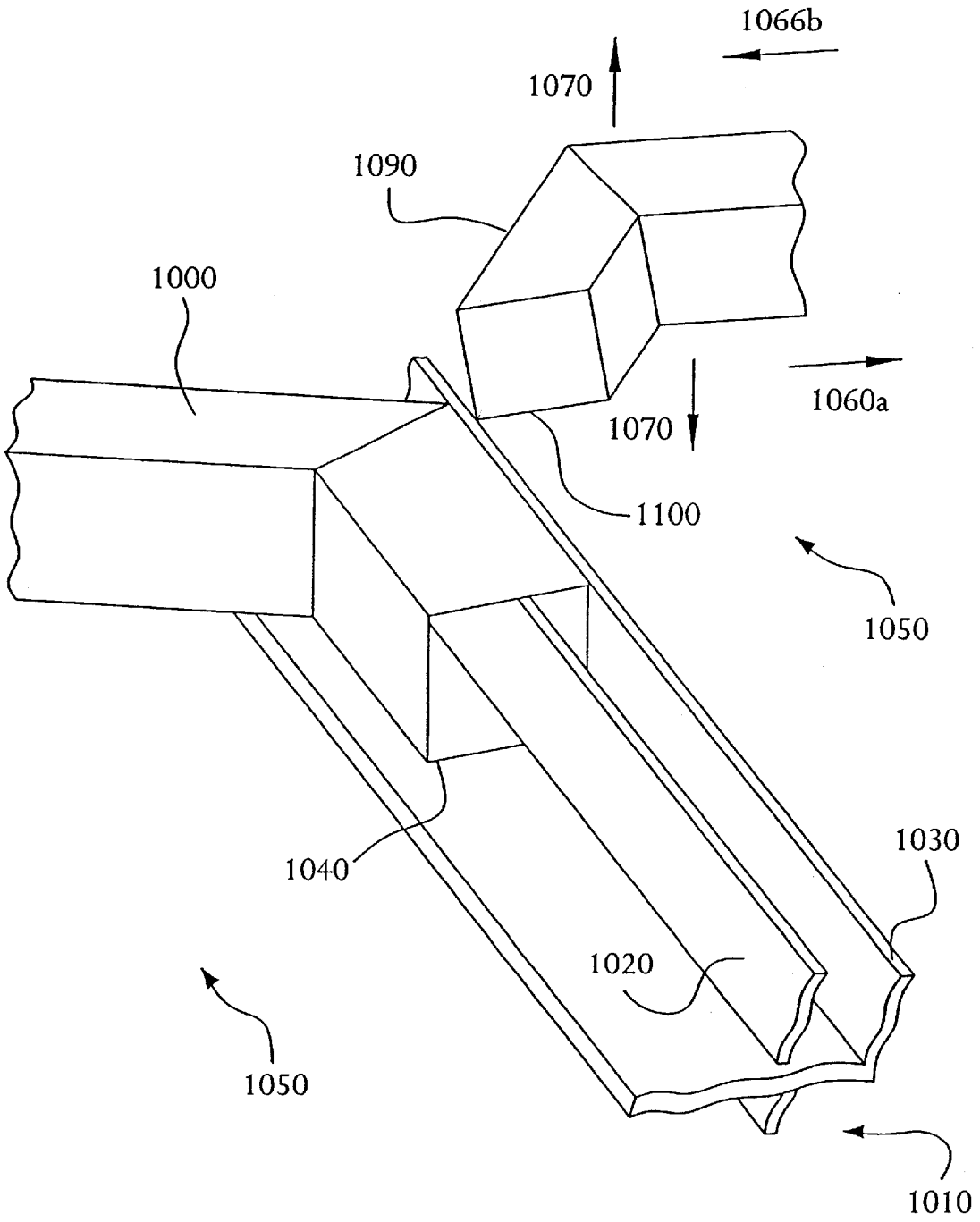
FIG. 13 is a partial perspective view of a separator including a knife separating a flange from an extruded member.

FIG. 12 shows a flow chart representation of a method 500 of creating a plurality of window frame members having specific end use applications from a master window frame member, such as master window frame member 10. At step 505, master window frame member 10 is extruded using a master window frame member die in a conventional extrusion process. At step 510, the soft extruded master window frame member 10 is cooled and shaped in a cooling section or calibrator using a known calibration process to harden the master window frame member 10. The hardened master window frame member is then pulled, for example by a conveyor belt or plurality of cooperating conveyor belts, from the cooling section into a separator section at step 520. An example of such a separator section is shown in FIG. 13.

At step 530, a window frame member having a particular end use application is selected to be created from the master window frame member 10. At step 540, if window frame member 10*f* (FIG. 6), window frame member 10*c* (FIG. 7), or window frame member 10*e* (FIG. 9) has been selected to be created from master window frame member 10, then master window frame member 10 is cut at step 550 at predetermined location 370, thereby removing flange 30. At step 560, if window frame member 10*e* was selected or, at step 570, if window frame member 10*a* was selected, then master window frame member 10 is cut at predetermined location 320 to remove flange 20. At step 600, if window frame member 10*f* was selected or at step 570 if window frame member 10*a* was not selected (i.e., window frame member 10*b* has been selected), then master window frame member 10 is cut at predetermined location 330 at step 590, thereby removing fin 20 above cover fin 60. If, at step 600, window frame member 10*f* was not selected, then window frame member 10*c* has been selected and no further cuts need be made. At step 610, any pieces of master window frame member 10 that have been cut may be recycled.

At cutting steps 550, 580, 590, master window frame member 10 is preferably cut in a separator section by, for example, a scarfing knife or other sharp blade. FIG. 13 is a partial perspective view of a separator 1000 separating a flange 1020 from an extruded member 1010 as the extruded member 1010 is pulled in the direction of directional arrows 1050. The separator section 1000 includes a cutting tool such a knife or blade edge 1040 that helps cut the flange, 1020 from extruded member 1010. The extruded member 1010 includes two flanges 1020, 1030, like master window frame member 10. Any pieces of extruded member 1010 that are separated or cut from extruded member 1010 by the blade edge 1040 may then be directed to a recycling or gathering section (not shown) through separator 1000. These pieces may then be ground so that they may be reused in the extrusion process. A separator section 1000 is therefore preferably shaped to guide any severed pieces away from extruded member 1010.

Cutting may also be facilitated by positioning a trimming knife, such as a single blade or knife edge, to partially cut through a flange of a master window frame member 10 at a cutting groove, such as a cutting groove 325 or cutting groove 335. The extruded cutting grooves help direct a trimming knife to cut in the correct location. A partially cut flange is easier to separate from a master window frame member 10 than a non-cut flange. The trimming knife may, for example, be placed between the die section and the calibrator section. The trimming knife may be made to engage the extruded master window frame member if a window frame member having a particular end use application is to be created by separating a flange from the master window frame member 10. Of course, multiple trimming knifes may be placed on line, or adjustable trimming knifes may be used that are capable of cutting a master window frame member 10 at a plurality of locations.

The selection at step 530 concerning which window frame member to create from the master window frame member 10 may be made by engaging and disengaging the cutting tools in the correct combination. For example, if window frame member 10*e* is selected at step 530 to be created from master window frame member 10, the scarfing knifes or blades that cut at predetermined location 370 and predetermined location 320 are enabled and the scarfing knife or blade that cuts at predetermined location 330 is disengaged. An adjustable cutting tool may be substituted for two or more cutting tools. A single cutting tool may then be used to cut at more than one predetermined location by adjusting the cutting tool to cut at one of several possible cutting locations. For example, a single adjustable cutting tool may be used to cut at predetermined cutting location 320 and at predetermined cutting location 330, depending upon which window frame member has been selected. FIG. 13 shows a second separator section 1090 which is disengaged so that only separator 1000 cuts a flange 1020 of an extruded member 1010. Separator section 1090 may be disengaged, for example, by moving separator section 1090 in the direction of directional arrow 1060*a*. Conversely, separator section 1090 may be engaged by moving separator section 1090 in the direction of directional arrow 1060*b*. The separator section 1090 may be moved along directional arrows 1070 to cut at more than one location along flange 1030. Again, separator section 1090 includes a cutting tool such as a knife or blade edge 100 to facilitate cutting. Also, the separator section 1100 is preferably shaped to guide separated pieces away from the extruded member 1010 as it is pulled down a production line.

Figure 4:
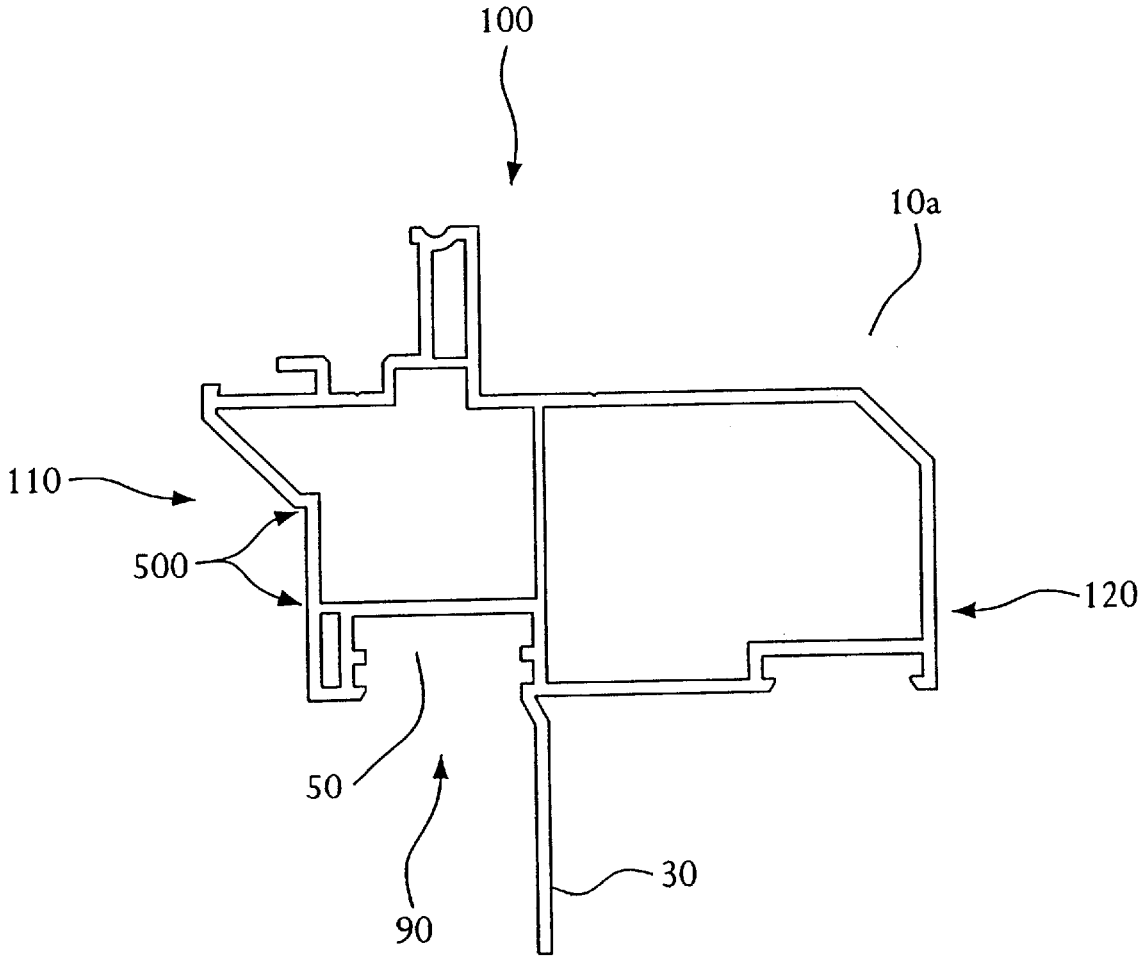
FIG. 4 is a profile view of an exemplary embodiment of the window frame member of FIG. 1 having first flange portion for attaching the frame member to a building structure.

FIG. 4 is a profile view of a window frame member 10*a* that may be created from master window frame member 10. The window frame member 10*a* includes a first flange portion 30 that may be used as a nailing flange, but the flush fin 20 and cover fin 60 have been removed. This window frame member 10*a* is typically used in new construction applications. An assembled window frame including frame member 10*a* may be mounted in an opening 230 of a wall. The nailing flange 30 extends radially outward from the wall-facing side 90 of frame member 10*a,* and therefore also from any frame 300 including a frame member 10*a,* and around the opening 230 of the wall 200. The frame member 10*a* and the frame 300 are then secured to the wall 200 by fasteners that are driven through the nailing flange 30 and into the wall 200. The flange 30 may also have nailing slots 306 (shown in FIG. 10) formed therein, such that the fasteners do not have to be driven or screwed into the flange portion 30. The preferred fasteners for such an installation are corrosion-resistant nails, such as galvanized roofing nails, aluminum nails or stainless steel nails, or screws.

Figure 5:
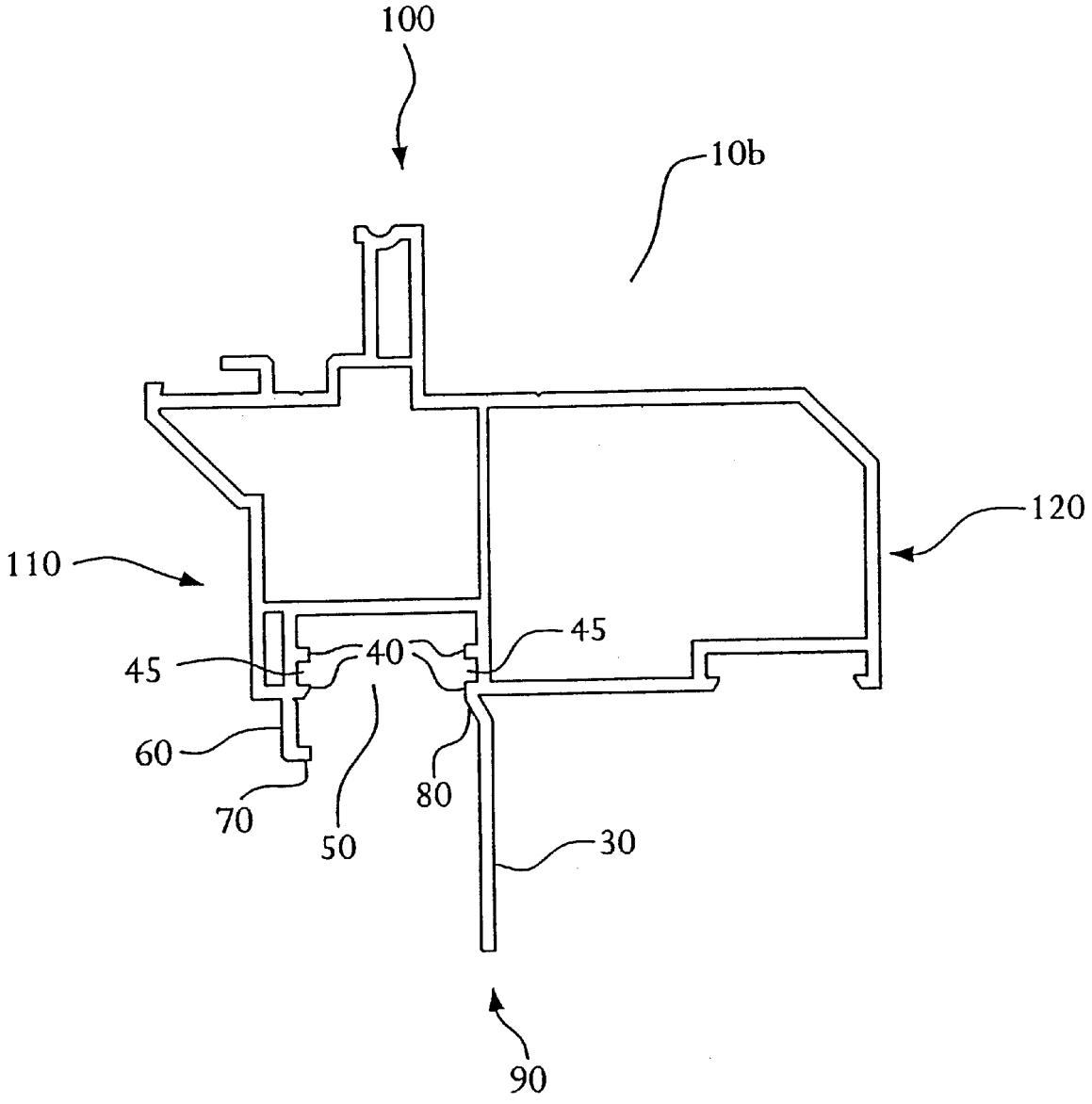
FIG. 5 is a profile view of an exemplary embodiment of the window frame member of FIG. 4 having a second flange portion for covering a siding or sheathing product attached to a building.
Figure 5A:
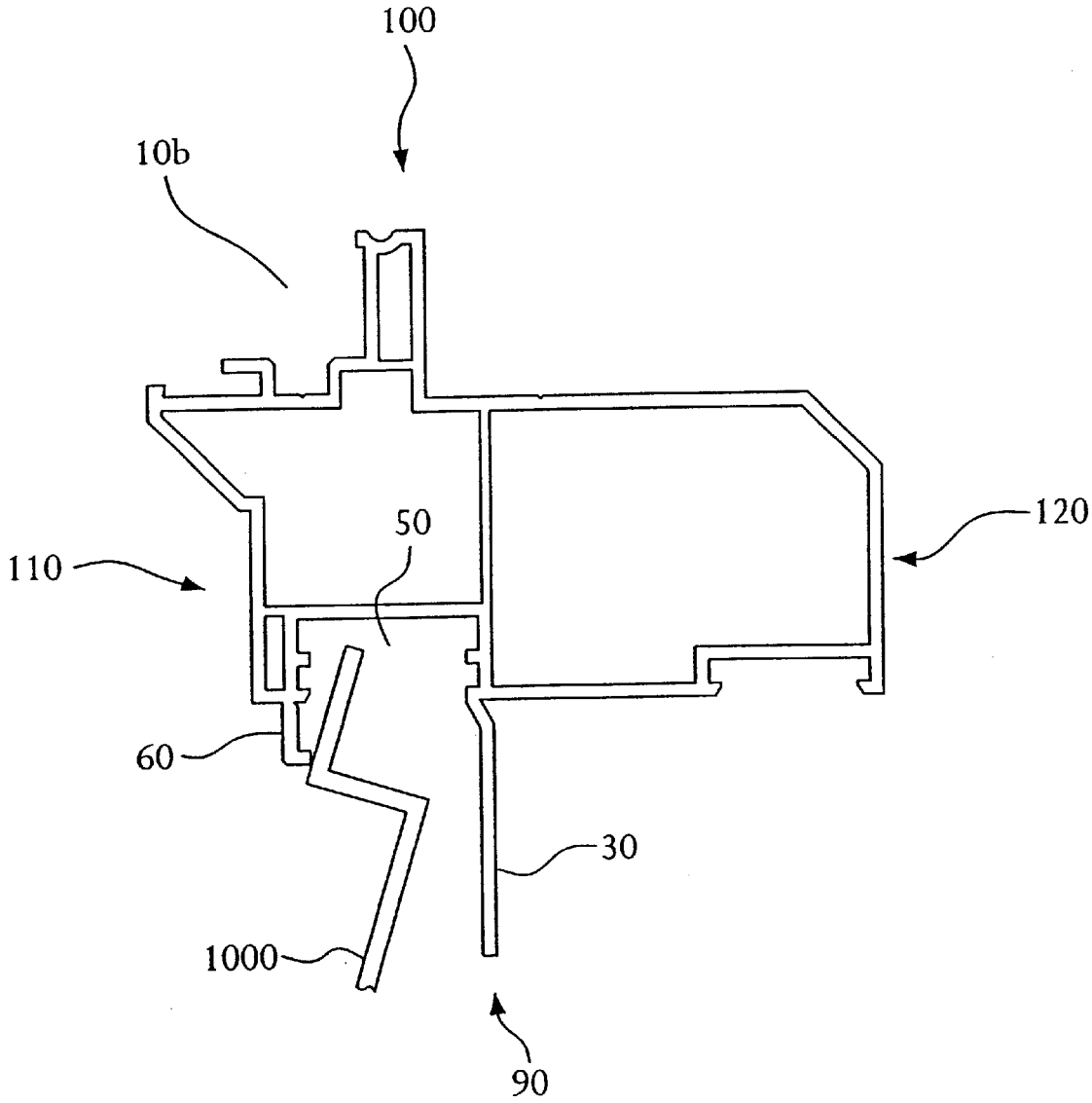
FIG. 5A depicts the window frame member of FIG. 5 accepting and covering the edge of a siding or sheathing product.

FIG. 5 is a profile view of another exemplary embodiment of a window frame member 10*b* that may be created from the master window frame member 10. Like window frame member 10*a,* window frame member 10*b* includes a first flange portion 30 that may be used as a nailing flange during a new construction application as described above. Window frame member 10*b* also includes a second flange portion 60, but the flush fin flange 20 has been cut at predetermined location 330. This second flange portion 60 may be used as a cover fin for covering at least a portion of a siding or sheathing product 1000 that is pocketed in channel 50, such as is shown in FIG. 5A. The details of the function of second flange portion 60 and channel 50 are disclosed hereafter.

Figure 6:
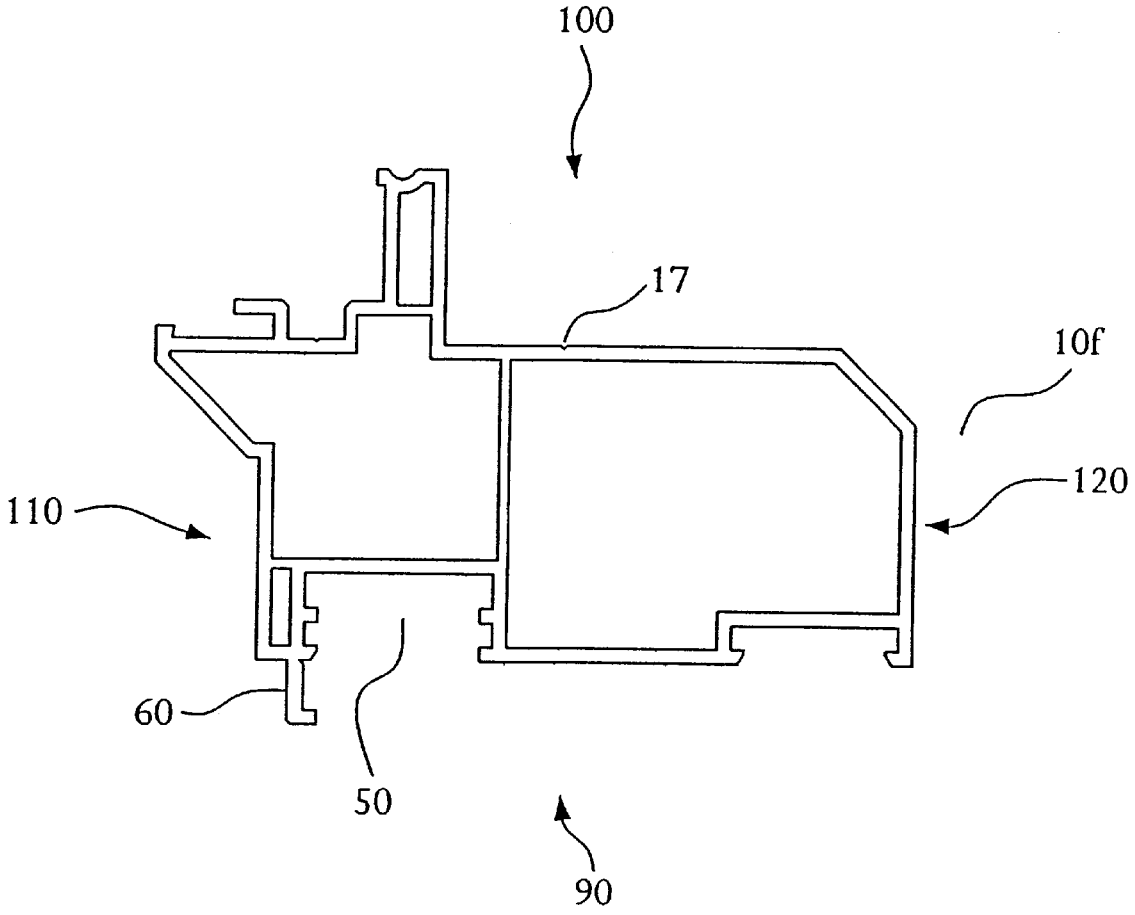
FIG. 6 is a profile view of an exemplary embodiment of the window frame member of FIG. 1 without a nailing flange or a flush fin flange.

Alternatively, the window frame member 10*f* as shown in FIG. 6 may include the flange portion 60, but not the flange portion 30. The flange portion 60 and channel 50 function in the same manner as the flange portion 60 and channel 50 of window frame member 10*b,* as described hereafter. Because the window frame member 10*f* does not include a nailing flange 30, the window frame member 10*f,* and any window frame including window frame member 10*f,* must be fixedly mounted in the opening of a wall in another manner, such as by nailing or screwing the window frame member 10*f* to an existing window frame or rough opening through the window-facing side 100, preferably at groove 17, and through wall-facing side 90.

Figure 7:
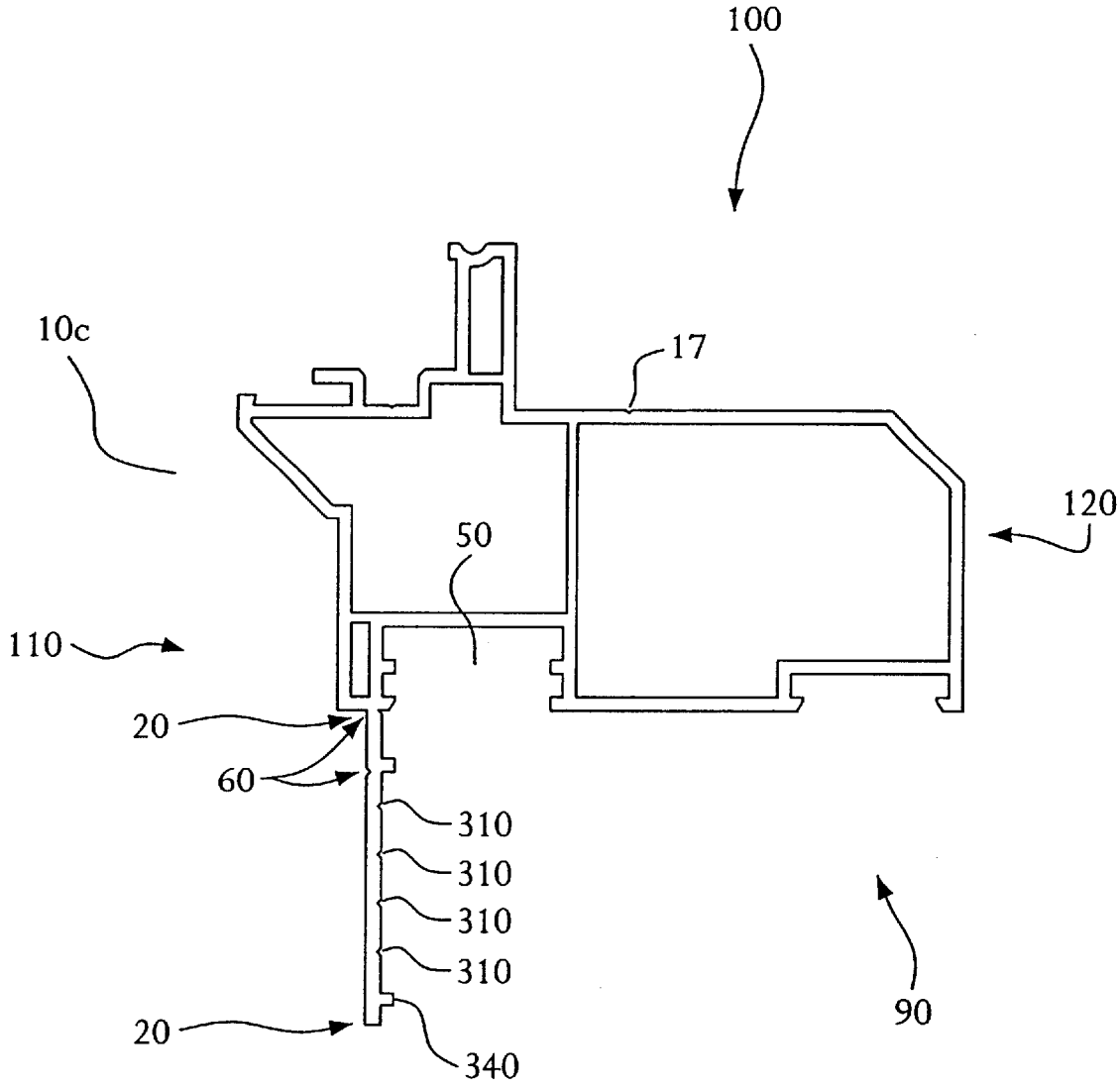
FIG. 7 is a profile view of an exemplary embodiment of the window frame member of FIG. 1 having a full flush fin flange.

FIG. 7 is a profile view of an exemplary embodiment of the window frame member 10*c* that may be created from the master window frame member 10. Unlike window frame member 10*a* and window frame member 10*b,* window frame member 10*c* does not include a flange 30. The window frame member 10*c* does include a flange portion 20, however, that may be used as a flush fin. As already described, a flush fin is usually used in replacement window application to cover any gaps between the replacement window frame and the wall or any damaged areas, such as those that may occur or be present when replacing windows in a structure having a stucco exterior. The flange portion 20 is not typically used to attach frame member 10*c* to the structure, although a caulking seal is preferably created between the flush fin 20 and the wall 200 of a structure. In the replacement application, a window frame including the window frame member 10*c* is secured to the structure by nailing or screwing the window frame to an existing window frame or rough opening through the window-facing side 100, preferably at groove 17, and through wall-facing side 90.

Figure 8:
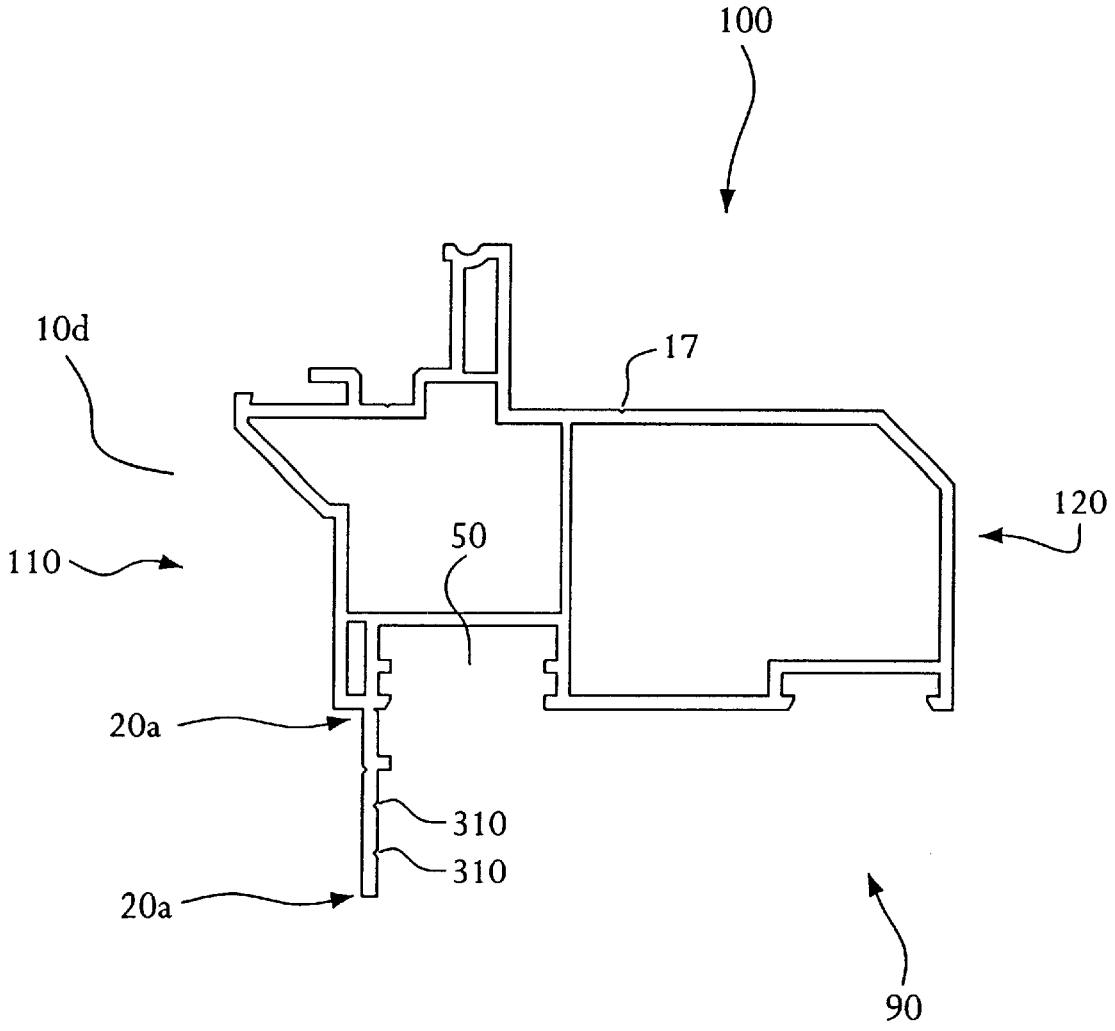
FIG. 8 is a profile view of an exemplary embodiment of the window frame member of FIG. 7 having a partially severed flush fin flange.

The flush fin 20 may also have a protrusion 340 disposed at an end remote from the wall-facing side 90 and on a side facing the exterior wall 210 after installation of window frame member 10*c*. This protrusion 340 helps to seat the flush fin 20 against the exterior wall 210. The flush fin 20 may also include field cutting grooves 310 formed on the flush fin 20 during the extrusion process. The field cutting grooves 310 are shown disposed on the side of the flush fin 20 facing the exterior wall 210 after installation, although the field cutting grooves 310 may be disposed on the opposite side of flush fin 20. Also, the field cutting grooves 310 are preferably spaced at equal intervals from each other. The field cutting grooves 310 permit an installer to easily and precisely cut the flush fin 20 to a desired coverage length using a knife or other cutting tool. FIG. 8 shows a profile view of an exemplary embodiment of a window frame member 10*d* having a flush fin 20*a* that has been cut to a desired length at a field cutting groove 310.

Figure 9:
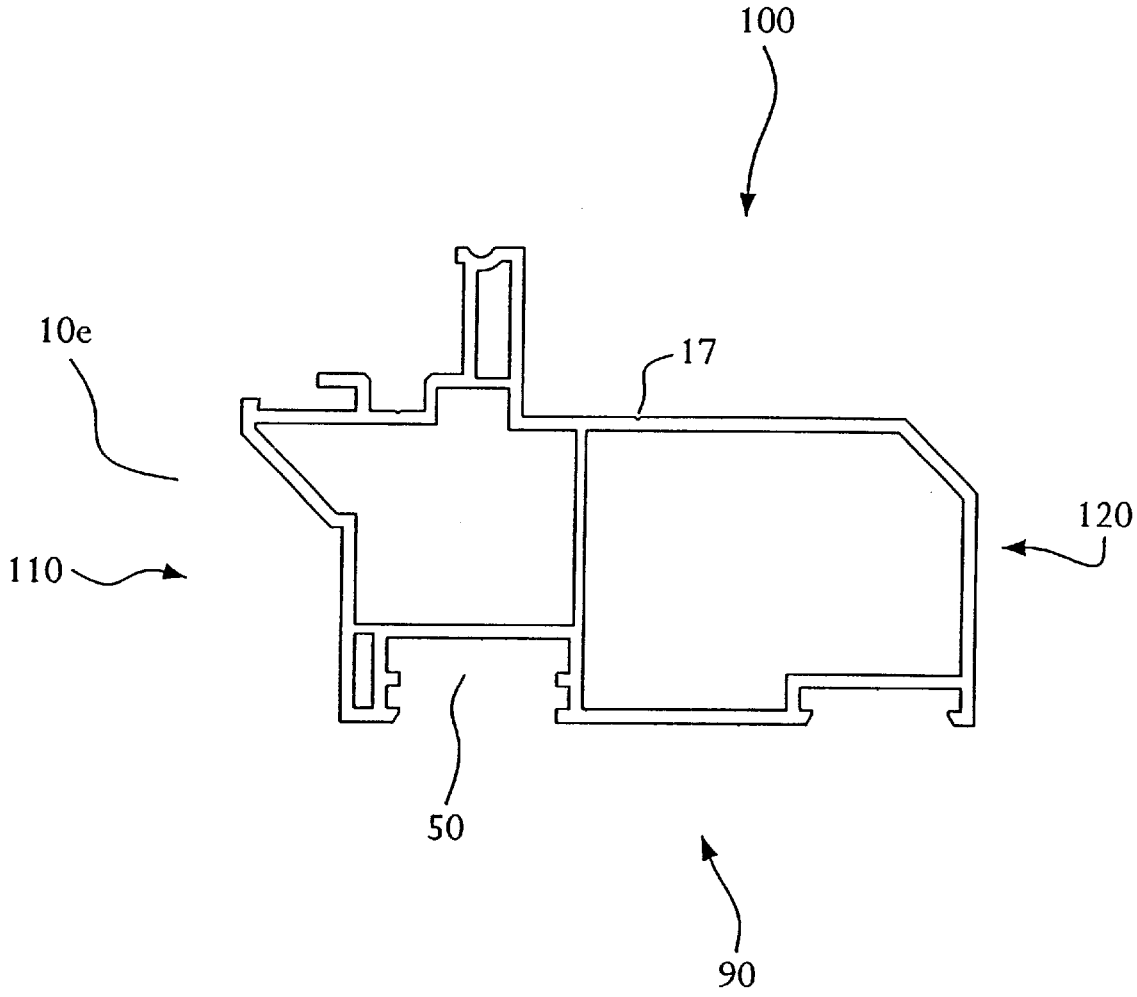
FIG. 9 is a profile view of an exemplary embodiment of the window frame member of FIG. 1 without any flanges.

FIG. 9 shows a profile view of an exemplary embodiment of window frame member 10*e* that may be created from the master window frame member 10. Window frame member 10*e* includes neither a first flange portion nor a second flange portion extending from the wall-facing side 90 of window frame member 10*e*. A window frame member having neither the first flange portion nor the second flange portion, like window frame member 10*e,* is typically included in a replacement window frame assembly. Like the flush fin 20 application described above, the window frame member 10*e* may be fixedly secured to an existing frame or a rough opening by nailing or screwing the window frame to an existing window frame or rough opening through the window-facing side 100, for example at groove 17, and through wall-facing side 90.

Figure 11:
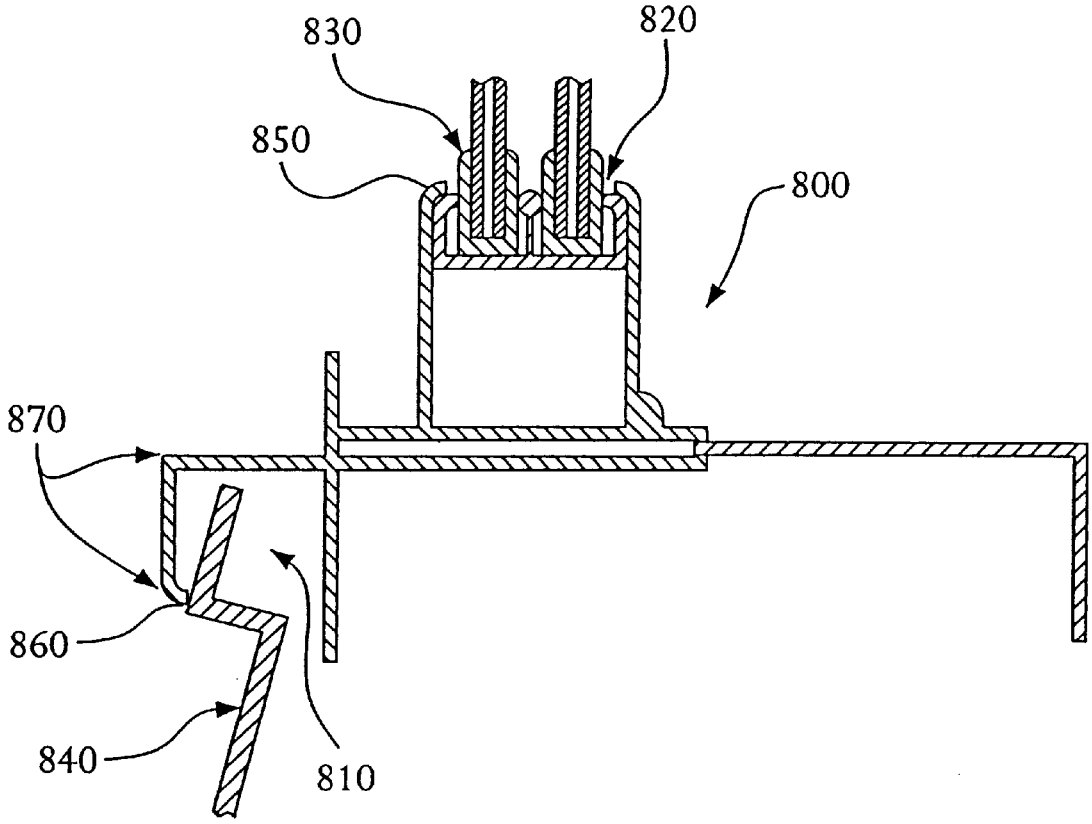
FIG. 11 (PRIOR ART)
FIG. 11 is a cross-sectional side elevational view of a prior art window frame member having an integral J-channel.

Referring to FIG. 11, a cross-sectional profile view of a prior art window frame member 800 having an integral J-channel 810 is shown. Two window sashes 820,830 are shown seated on the window frame member 800. Siding 840, shown in partial, is seated in the J-channel 810. The sight-line for the prior art window frame member 800 is defined by lines 850,860. A standard siding coverage area 870 is approximately 0.750 inches, a value that has been found to adequately cover the ends of a siding or sheathing product during expansion and contraction of the siding or sheathing due to temperature changes. As can be seen from FIG. 11, the siding coverage area 870 of the J-channel 810 adds to the sight-line 850,860 of the window frame member 800.

The present invention reduces or eliminates the sight-line problems created by prior art window frame members with integral J-channels. Referring to FIG. 5, a channel 50 is formed within the body of the frame member 10*b*. The channel 50 is capable of accepting an edge of an exterior siding or sheathing product 1000 attached to the structure, as shown in FIG. 5A. The channel 50 and second flange portion 60 cooperate to cover an edge of the exterior siding or sheathing product 1000. Because the channel is formed at least partially within the cross-sectional area defined by the interior and exterior surfaces 120, 110 and window-facing and wall-facing sides 100, 90 of the window frame member 10*b,* the second flange portion 60 may extend less than the 0.750 inch normally required to cover an edge of the siding or sheathing product 1000 during expansion or contraction of the same. Further, because the second flange portion 60 may be constructed to extend less than 0.750 inch, the length of the first flange portion 30 may be reduced from its normal 1.750 inch length to a length equal to 1 inch plus the length of the second flange portion 60. It should be apparent that this design, then, produces significant savings in material expenditures. The present invention also reduces the sight-line of the frame member by the depth of the channel 50 because the second flange portion 60 does not contribute a full 0.750 inch to the sight-line.

In another embodiment of the present invention, a window frame member, such as the window frame member 10*a* of FIG. 4 or the widow frame member 10*e* of FIG. 9, may be designed to have a channel 50 that include the entire 0.750 inch necessary to accept and cover an edge of a sheathing or siding product 1000 during expansion or contraction of the sheathing or siding product. This embodiment of the invention conserves still more manufacturing materials because no flange, such as flange 60, is required to cover the siding or sheathing product 1000. Also, if the frame member includes flange 30, as window frame member 10*a* does, flange 30 needs to extend from wall-facing side 90 only a length long enough to provide a sufficient nailing face, i.e., approximately 1 inch. Further, the ability of the frame member to cover an edge of a siding or sheathing product does not increase the sight-line of the window frame member if the channel 50 extends the full 0.750 inch, i.e., the frame member covers the siding or sheathing product but the 0.750 inch coverage does not contribute to the sight-line. It should be noted that the weep housing attachment area 500 will decrease as the depth of the channel 50 increases because it is preferable that the weep housing does not protrude into the channel 50.

Figure 2A:
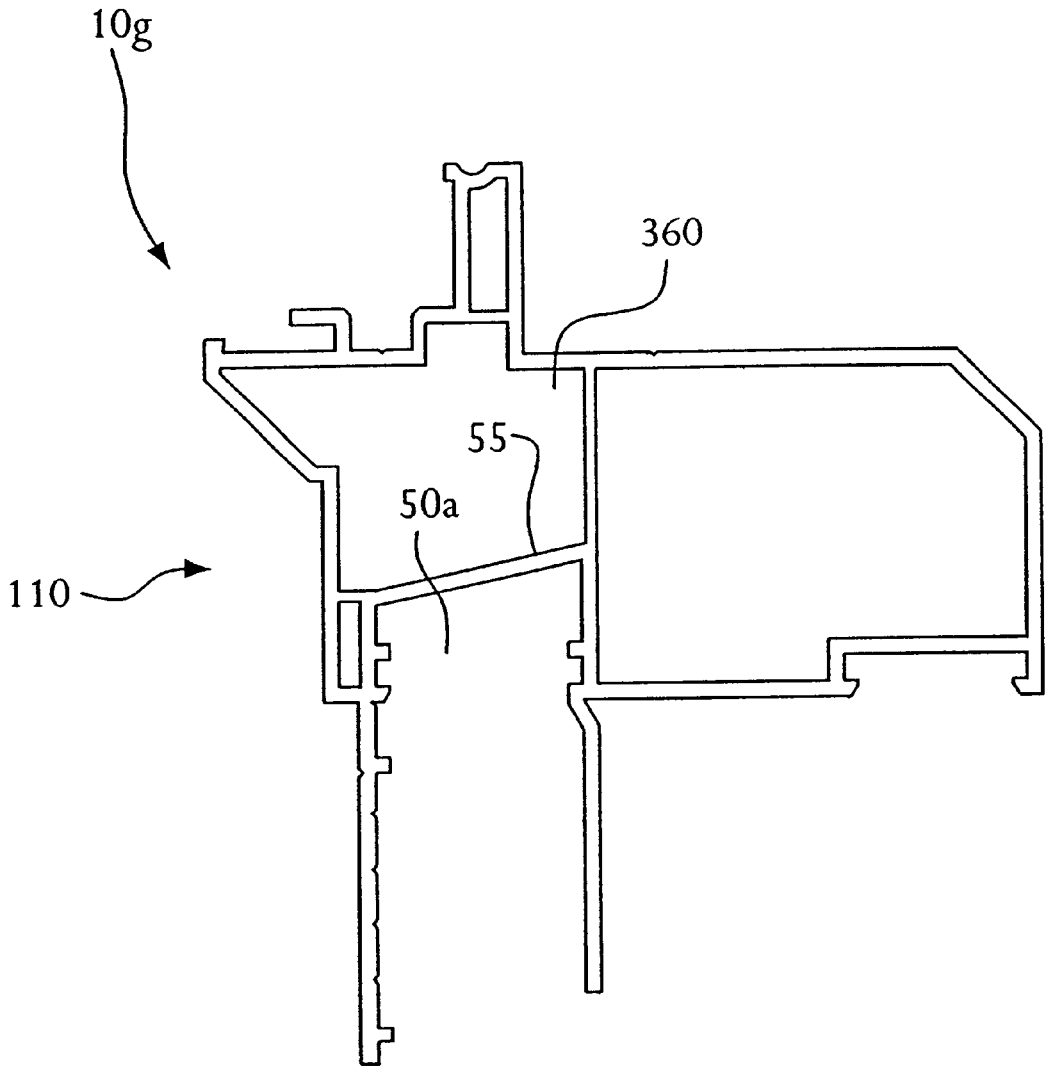
FIG. 2A is a profile view of a master window frame member having a trapezoidal channel formed within the frame member.
Figure 2B:
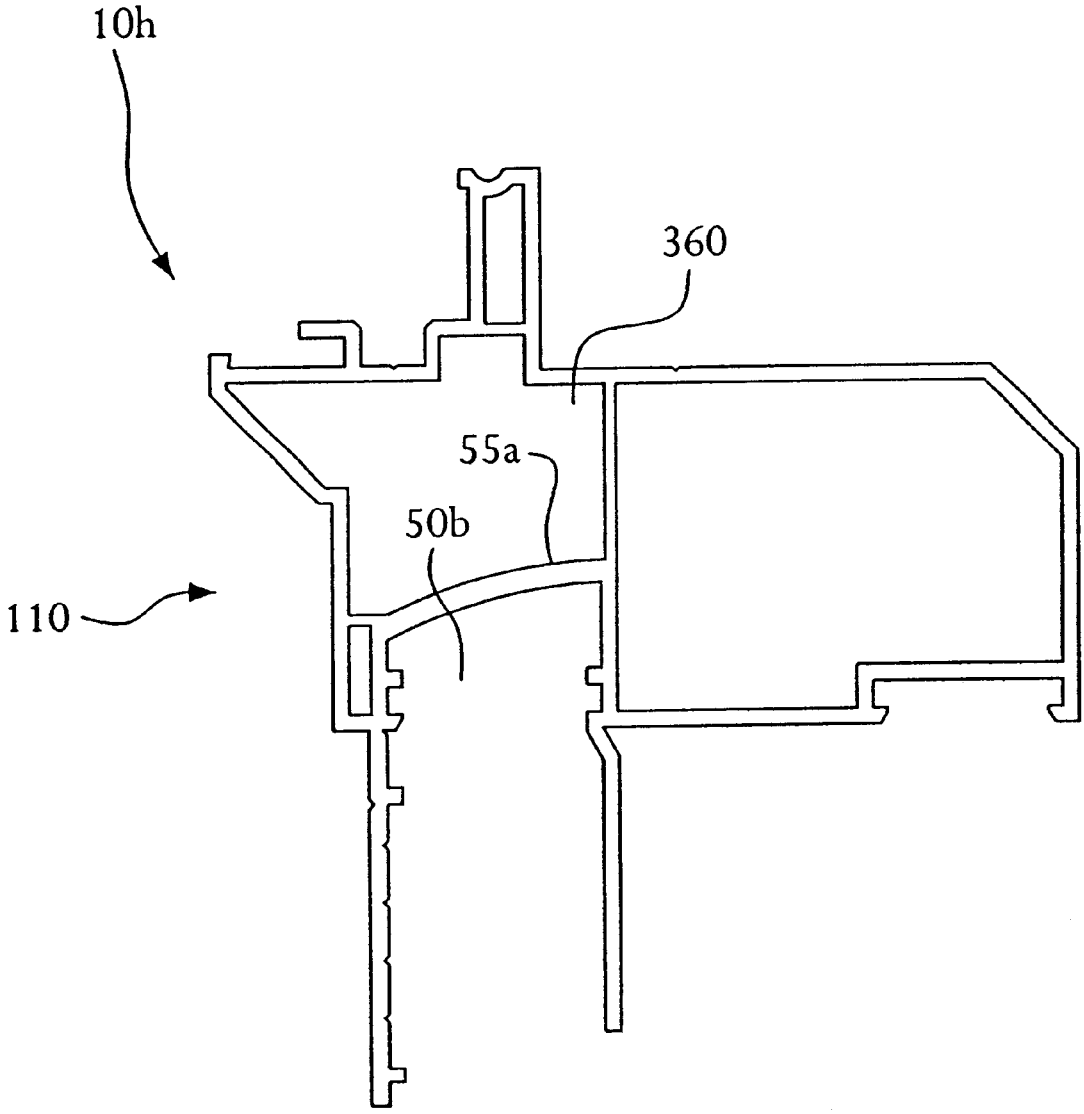
FIG. 2B is a profile view of a master window frame member having a channel including a curved wall formed within the frame member.

The channel 50 as shown, for example, in FIGS. 5 and 9, has a rectangular shape. The channel 50 may also have other shapes such as a trapezoidal shape as shown by channel 50*a* of window frame member 10*g* of FIG. 2A, or the channel 50 may have a curved wall such as channel 50*b* of window frame member 10*h* of FIG. 2B. If the channel is not rectangular, it is preferable that a base wall 55 of channel 50*a* or a base wall 55*a* of channel 50*b* be disposed to direct any fluid that collects in weep cavity towards exterior surface 110.

Several other features relevant to the seating of a siding or sheathing product in channel 50 are also shown in the drawings. For example, FIG. 5 shows that channel 50 may have protrusions 40 that define an accessory pocket 45 within the channel 50. The accessory pocket 45 permits accessories to be attached if the channel 50 is not used to cover an edge of a siding or sheathing product 1000. Also, an angled guide 80 is shown connecting flange portion 30 to the wall-facing side 90. The angled guide 80 helps to guide a sheathing or siding product 1000 into the channel 50. Further, the cover flange portion 60 may also comprise a protrusion 70 disposed at an end remote from the wall-facing side 90 and on a side facing the first flange portion 30. The protrusion 70 acts to press siding or sheathing toward the flange portion 30 and away from the protrusions 40 disposed opposite flange portion 30, thereby ensuring that a siding or sheathing product 1000 does not become lodged beneath the protrusions 40.

The invention has been described using a master window frame member 10 designed for a picture window. The concepts described and claimed herein, however, apply equally to other window frame members and designs. The picture window frame member has been described for purposes of illustration only, and is not intended as a limitation on the scope of the invention. Further, a master window frame member having two flanges has been described. The concepts described herein, however, apply to master window frame members having more that two flanges. If a master window frame member includes more that two flanges, different functional frame members having different flange combinations could be created from the master window frame member using the concepts disclosed in this detailed description.

Further, although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

What is claimed is:

1. A method of making a plurality of window frame members having different end use applications on a single production line, comprising the steps of:

extruding a plurality of master window frame members during at least first and second production runs from a single die plate, each of said master window frame members having at least two flanges extending from a wall facing side of said master window frame member;

selectively cutting during said first production run a substantial portion of at least one flange from a first master window frame member from said plurality of master window frame members at a predetermined location to create a new construction window frame member having a nailing flange; and selectively cutting during said second production run on said single production line a substantial portion of at least one flange from a second master window frame member from said plurality of master window frame members at a predetermined location to create a replacement window frame member not having a nailing flange.

2. The method of claim 1, wherein said selectively cutting during said first production run step comprises the step of cutting a flange from said at least two flanges at an intermediate location on said flange to form a J-channel defined at least in part by said flange cut at said intermediate location, said J-channel being sized to accept an edge of an exterior siding or sheathing product attached to a structure, said edge being at least partially covered by said channel during expansion and contraction of same.

3. The method of claim 1, wherein said selectively cutting during said second production run step includes the step of cutting two flanges from said at least two flanges from said second master window frame member.

4. The method of claim 1, wherein said selectively cutting during said second production run step includes the step of cutting said at least one flange to form a replacement window frame member having a flush fin flange, said at least two flanges including said flush fin flange.

5. The method of claim 1, wherein said selectively cutting steps include the step of cutting at least one flange with an adjustable cutting tool.

6. The method of claim 1, wherein said extruding step includes the step of extruding said master window frame members from polyvinyl chloride.

7. The method of claim 1, further comprising the step of cooling said master window frame members in a calibrator before cutting said master window frame members.

8. The method of claim 1, wherein said extruding step includes the step of forming a cutting groove on a master window frame member at at least one predetermined location.

9. The method of claim 8, further comprising the step of partially cutting through a master window frame member at a selected one of said at least one predetermined location to facilitate separating a flange from said master window frame member.

10. The method of claim 1, wherein said step of selectively cutting during said second production run includes the step of selectively cutting said at least one flange to form a replacement window frame member having a flush fin flange, said at least two flanges including said flush fin flange, and wherein said extruding step includes the step of forming a plurality of cutting grooves on said flush fin flange, whereby said cutting grooves facilitate separation of a portion of said flush fin flange to provide a flush fin flange having a desired length.

11. A master window frame member extruded from a single die plate, said master window frame member comprising at least two flanges extending from a wall facing side of said master window frame member, said flanges being configured such that a first substantial portion of at least one of said flanges may be selectively cut at a predetermined location on said master window frame member to produce a new construction window frame member having a nailing flange and a second substantial portion of at least one of said flanges may be selectively cut at a predetermined location on said master window frame member to create a replacement window frame member not having a nailing flange.

12. The master window frame member of claim 11, wherein said master window frame member is configured such that selectively cutting a flange from said at least two flanges at an intermediate location on said flange produces a new construction window frame member having a J-channel defined at least in part by said flange cut at said intermediate location, said J-channel being sized to accept an edge of an exterior siding or sheathing product attached to a structure, said edge being at least partially covered by said channel during expansion and contraction of same.

13. The master window frame member of claim 11, wherein said at least one flange may be selectively cut to form a replacement window frame member having a flush fin flange, said at least two flanges including said flush fin flange.

14. The master window frame member of claim 13, wherein said flush fin flange includes a plurality of cutting grooves formed thereon, whereby said cutting grooves facilitate separation of a portion of said flush fin flange to provide a flush fin flange having a desired length.

15. The master window frame member of claim 11, wherein two flanges from said at least two flanges may be selectively cut to form a replacement window frame member.

16. A method of making a plurality of window frame members having different end use applications on a single production line, comprising the steps of:

extruding a plurality of master window frame members on said production line during at least first and second production runs from a single die plate, each of said master window frame member having at least two flanges including a flush fin flange and a nailing flange extending from a wall facing side of said frame member;

on said single production line, selectively cutting during said first production run a substantial portion of at least one flange from a first master window frame member from said plurality of master window frame members at a predetermined location to create a new construction window frame member having a nailing flange with at least a substantial portion of said flush fin flange being removed; and on said single production line, selectively cutting during said second production run a substantial portion of at least one flange from a second master window frame member from said plurality of master window frame members at a predetermined location to create a replacement window frame member with at least a substantial portion of said nailing flange being removed.

17. The method of claim 16, wherein said selectively cutting during said first production run step comprises the step of cutting said flush fin flange at an intermediate location on said flush fin flange to form a J-channel defined at least in part by said flush fin flange cut at said intermediate location, said J-channel being sized to accept an edge of an exterior siding or sheathing product attached to a structure, said edge being at least partially covered by said channel during expansion and contraction of same.

18. The method of claim 16, wherein said selectively cutting during said second production run step includes the step of cutting at least a substantial portion of said flush fin flange and said nailing flange from said second master window frame member.

19. The method of claim 16, wherein said selectively cutting during said second production run step includes the step of selectively cutting at least a substantial portion of said nailing flange to form a replacement window frame member having said flush fin flange.

20. The method of claim 16, wherein said step of selectively cutting during said second production run includes the step of selectively cutting said at least one flange to form a replacement window frame member having said flush fin flange, and wherein said extruding step includes the step of forming a plurality of cutting grooves on said flush fin flange, whereby said cutting grooves facilitate separation of a portion of said flush fin flange to provide a flush fin flange having a desired length.

* * * * *